US007387321B2

(12) United States Patent
Tanaka et al.

(10) Patent No.: US 7,387,321 B2
(45) Date of Patent: Jun. 17, 2008

(54) DOOR OUTER HANDLE OPENING OPERATION PREVENTION STRUCTURE

(75) Inventors: Takeki Tanaka, Kawachi-gun (JP); Kazuya Shibata, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 35 days.

(21) Appl. No.: 11/210,480

(22) Filed: Aug. 24, 2005

(65) Prior Publication Data

US 2006/0055185 A1 Mar. 16, 2006

(30) Foreign Application Priority Data

Aug. 31, 2004 (JP) ..... 2004-252686

(51) Int. Cl.
*E05B 3/00* (2006.01)

(52) U.S. Cl. ..... 292/336.3; 292/347

(58) Field of Classification Search ..... 292/336.3, 292/347, DIG. 31, DIG. 29, DIG. 63
See application file for complete search history.

(56) References Cited

U.S. PATENT DOCUMENTS

| | | | | |
|---|---|---|---|---|
| 4,747,632 | A * | 5/1988 | Joy | 292/347 |
| 5,174,619 | A * | 12/1992 | Bender et al. | 292/336.3 |
| 6,073,397 | A * | 6/2000 | Tanimoto et al. | 49/460 |
| 6,991,273 | B2 * | 1/2006 | Kim | 292/336.3 |
| 2001/0005084 | A1 * | 6/2001 | Ponziani | 296/56 |

FOREIGN PATENT DOCUMENTS

| | | |
|---|---|---|
| JP | 62-135761 | 8/1987 |
| JP | 09-136544 | 5/1997 |
| JP | 10-018664 | 1/1998 |
| JP | 10-297279 | 11/1998 |

* cited by examiner

*Primary Examiner*—Gary Estremsky
(74) *Attorney, Agent, or Firm*—Carrier, Blackman & Associates, P.C.; William D. Blackman; Joseph P. Carrier

(57) ABSTRACT

An opening operation prevention structure for a door outer handle includes a base plate, a side wall that projects from the base plate, and a handle lever that is rotatably supported by the side wall. The side wall includes an extension that covers the exterior of the handle lever when the base plate is viewed in a side view.

18 Claims, 4 Drawing Sheets

DOOR OUTER HANDLE OPENING OPERATION PREVENTION STRUCTURE

Priority is claimed on Japanese Patent Application No. 2004-252686, filed Aug. 31, 2004, the contents of which are incorporated herein by reference.

BACKGROUND OF THE INVENTION

1. Field of the Invention

The present invention relates to a door outer handle opening operation prevention structure for preventing the opening of a back door of a vehicle such as an automobile, due to erroneous operation of a door outer handle attached to the back door.

2. Description of Related Art

For example, in a vehicle such as an automobile, there is one known arrangement where an opening operation prevention structure is employed for a door outer handle, so that a door is not opened erroneously when it receives an impact (for example, refer to Japanese Unexamined Patent Application, First Publication No. 10-297279).

In this conventional opening operation prevention structure, there is provided a weight that is moved to a lock position by inertial force when an impact acts thereon. By fixing this weight in a position where the weight interferes with the rotation locus of a handle arm of the door outer handle, the opening operation of the handle arm is prevented.

However, in the conventional technique, there is a problem in that since the weight and related parts are required, the structure becomes complicated and the number of parts is increased.

The present invention takes the above problem into consideration, with an object of providing a door outer handle opening operation prevention structure that can reliably prevent the opening operation of the door outer handle, while maintaining a simple structure and without increasing the number of parts.

SUMMARY OF THE INVENTION

In order to achieve the above object, the present invention adopts an opening operation prevention structure for a door outer handle including: a base plate; a side wall that projects from the base plate; and a handle lever that is rotatably supported by the side wall, wherein the side wall is furnished with an extension that covers the exterior of the handle level when the base plate is viewed in a side view.

By having such a structure, even if a peripheral part comes close to the vicinity of the handle lever due to an impact, since the extension that projects from the side wall of the base plate which supports the handle lever will collide with the peripheral part, the peripheral part can be prevented from reaching or engaging the handle lever. As a result, collision of the peripheral part with the handle lever and associated rotation of the handle lever in the opening direction can be prevented. Consequently, the opening operation of the door outer handle can be reliably prevented with a simple structure without increasing the number of parts.

The side wall may be provided on both ends of the base plate.

In this case, it is possible to prevent collision of the peripheral part with the handle lever due to the impact, at both sides of the base plate. Consequently, the opening operation of the door outer handle can be more reliably prevented with a simple structure without increasing the number of parts.

The extension may be provided so that when the base plate is viewed from the front, the extension is separated further outwards than the handle lever.

In this case, the extensions can be kept from blocking the rotation operation of the handle lever. Therefore, the normal operation of the handle lever can be smoothly performed.

The extensions may be covered with a handle cover garnish.

In this case, the extensions can be kept from being seen from the outside. Therefore, there is an effect in that the appearance quality can be improved.

A position of a tip of the extension, and a position of a tip edge of the handle lever may be the same when viewed from the side.

In this case, it becomes possible to project the tip edge of the handle lever to the maximum. Therefore, the operability of the handle lever can be improved while preventing erroneous opening operation of the handle lever by means of the extension.

DETAILED DESCRIPTION OF THE INVENTION

Figure 1:
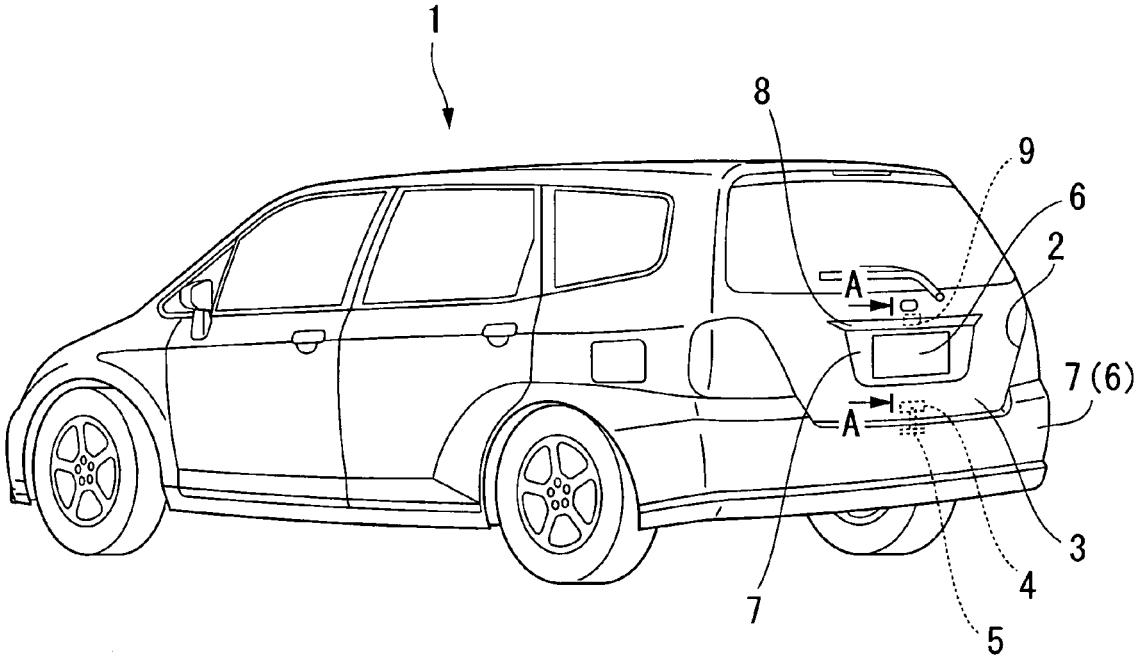
FIG. 1 is a rear perspective view of a vehicle comprising a door outer handle opening operation prevention structure according to an embodiment of the present invention.

Hereunder is a description of an embodiment of an opening operation prevention structure for a door outer handle of the present invention, with reference to the drawings. FIG. 1 is a rear perspective view of a door outer handle opening operation prevention structure according to the present embodiment, applied to a tailgate, being the back door of a vehicle. As shown in FIG. 1, a tailgate 3 is provided at a rear opening 2 of a vehicle body 1 so as to be capable of opening and closing. A locking device 4 is attached at the vehicle widthwise center on the lower side of the tailgate 3. Corresponding to the locking device 4, a striker 5 is attached to the rear opening 2. When the tailgate 3 is closed, the striker 5 is latched with the locking device 4, so that the closed (latched) state of the tailgate 3 is maintained.

On the lower half of the tailgate 3, an attaching portion 7 for a license plate 6 is provided as a recess of an approximate inverted trapezoidal shape. On the upper portion of the attaching portion 7, is provided a door outer handle 9 at a position that is hidden from the outside due to being covered with a handle cover garnish 8 described later. By the opening operation of the door outer handle 9, the latched state of the locking device 4 and the striker 5 is released, and the tailgate 3 is opened.

Figure 2:
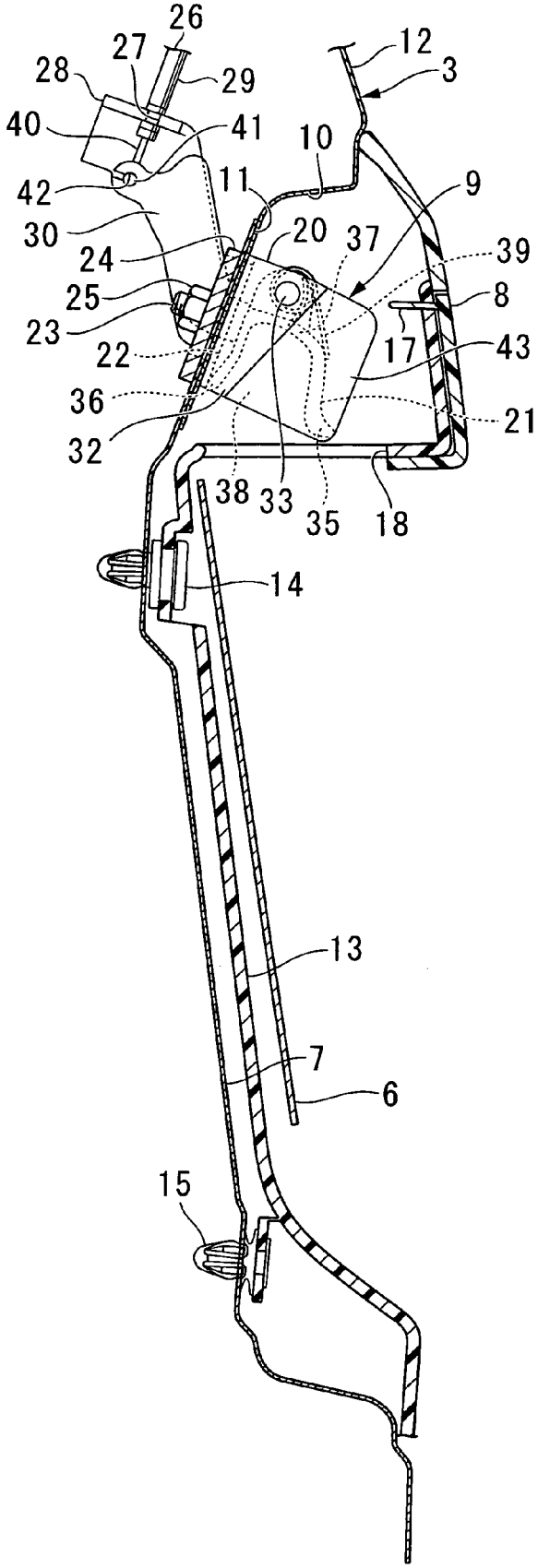
FIG. 2 is a cross-sectional view taken along the line A-A of FIG. 1.

As shown in FIG. 2, an outer panel 10 of the tailgate 3 has an attachment face 11 for the door outer handle 9 on an upper portion of the attaching portion 7 for the license plate 6. A plastic handle cover garnish 8 is attached in a position continuous with the general face 12 of the outer panel 10, on the upper edge of the attachment face 11. A plastic license garnish (peripheral part) 13 is fixed by clips 14 and 15 to the attaching portion 7 for the license plate 6 of the outer panel 10 so as to cover it. An upper portion of the license garnish 13 is formed bent in a crank shape. It is projected to the outside, then bent up while overlapping the backside of a bent portion 16 of the handle cover garnish 8, and is then latched to a latch projection 17 of the handle cover garnish 8. A license plate 6 is fixed to the upper face of the license garnish 13 by bolts (not shown). In the crank shaped portion of the license garnish 13, a later described opening 18 for operating the door outer handle 9 is formed.

The door outer handle 9 is attached to the attachment face 11 on the outer panel 10.

Figure 3:
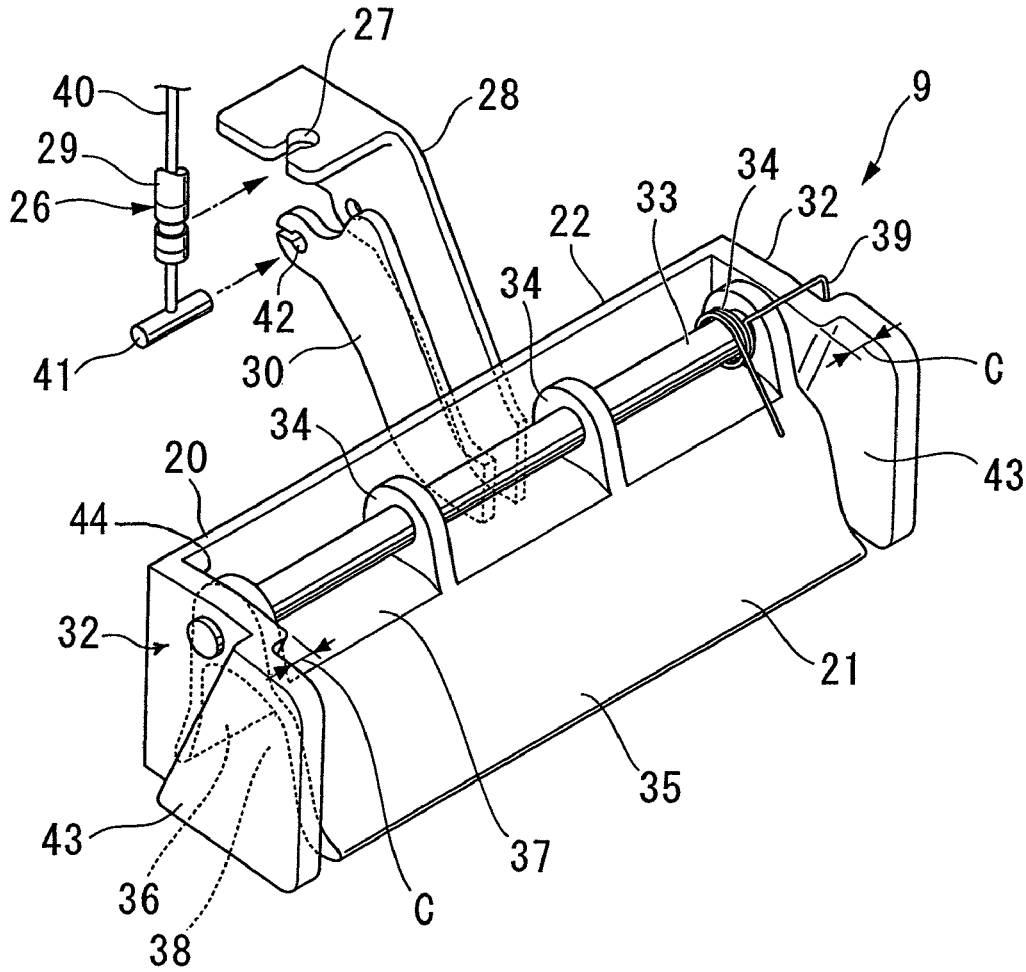
FIG. 3 is a perspective view of a door outer handle.
Figure 4:
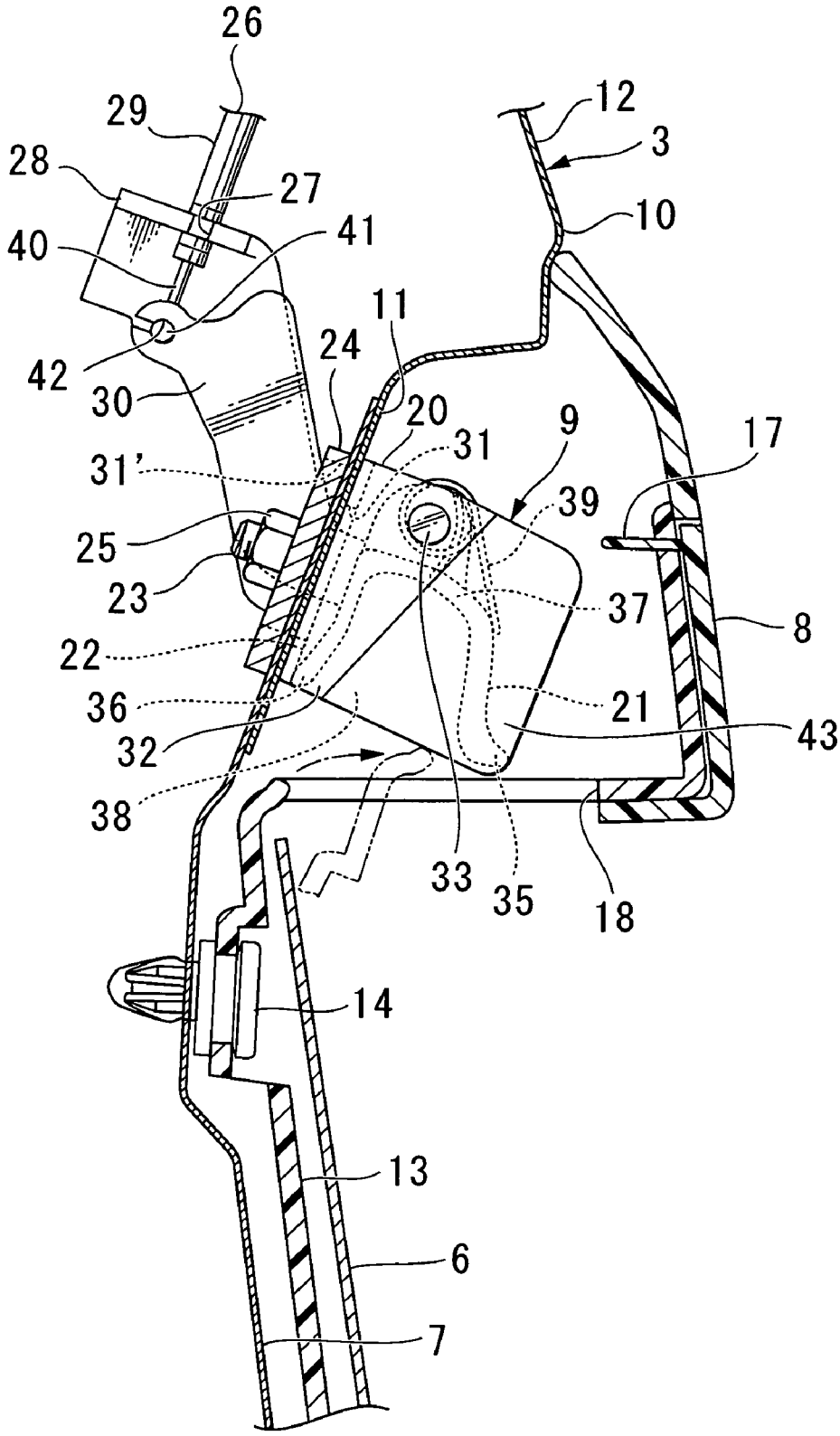
FIG. 4 is a cross-sectional explanatory view showing a deformed license garnish.

As shown in FIGS. 3 and 4, the door outer handle 9 includes a base plate 20, and a handle lever 21 that is rotatably supported on the base plate 20. The base plate 20 is a metal member, with stud bolts 23 (not shown in FIG. 3) provided on a rear wall 22 thereof. The stud bolts 23 are inserted into a back plate 24 that is provided on the backside of the outer panel 10, passing through the outer panel 10. Furthermore, they are fastened from the backside of the outer panel 10 by nuts 25.

The back plate 24 is provided with an arm 28 formed with a clamp portion 27 for latching a latch releasing cable 26. The arm 28 is formed so that it rises upward, and an upper end thereof is bent in the vehicle widthwise direction. Here, the clamp portion 27 is formed for latching an outer tube 29 of the latch releasing cable 26. A later mentioned arm 30 of the handle lever 21 is inserted through the rear wall 22 of the base plate 20, and the back plate 24, and notches 31 and 31' are formed for allowing vertical movement of the arm 30 (refer to FIG. 4).

Side walls 32 that project backwards in the vehicle traveling direction, are respectively formed on both ends of the rear wall 22 of the base plate 20. The handle lever 21 is rotatably supported between these side walls 32. Specifically, a shaft 33 is inserted, in the vehicle widthwise direction, between the respective side walls 32, and the handle lever 21 is rotatably supported on the shaft 33. A plurality of (four in the example shown in the drawing) support brackets 34 through which the shaft 33 is inserted, are provided on an upper portion of the handle lever 21. Moreover, the lower portion of the handle lever 21 is formed so that an operator's fingers can readily enter.

The handle lever 21 is formed in an approximate U-shape in cross-section, by an outer piece 35, an inner piece 36, and a top wall 37 having the respective support brackets 34, and a receiving region 38 is formed thereinside.

An edge portion of the outer piece 35 is formed in a curve so as to rise up slightly. Between the outer piece 35 and the side wall 32 of the base plate 20, is provided a torsion spring 39 that urges from a latch release position (opening operation position) towards a standby position. The inner piece 36 is integrally formed with the swing arm 30 which projects through the notches 31 and 31' formed in the rear wall 22 of the base plate 20, and in the back plate 24. An engagement hole 42 through which a latch end 41 of an inner wire 40 of a latch releasing cable 26, is inserted to latch therewith, is formed in a tip end of the swing arm 30.

In a portion enclosing the axial opposite ends of the handle lever 21 in the standby position, on the respective side walls 32 is respectively provided with extensions 43 projecting outwards in the vehicle widthwise direction away from the handle lever 21. These extensions 43 are provided axially outside of the handle lever 21, that is, so as to be mutually separated along the vehicle widthwise direction. As a result, when viewed from the rear of the vehicle body, a certain level of clearance C (refer to FIG. 3) is ensured respectively between the axial opposite ends of the handle lever 21 and the extensions 43. Moreover, when viewed in a side view as shown in FIGS. 2 and 4, the tips of the respective extensions 43, and the tip edge of the handle lever 21 are provided so as to be in approximately the same position so that the handle lever 21 does not protrude from the extensions 43. As shown in FIG. 3, it will be understood that, each of the side walls 32 includes an inner portion 44 formed integrally with the extensions 43.

The handle cover garnish 8 is arranged on the vehicle longitudinal rear side of the extensions 43, and the extensions 43 are covered with this handle cover garnish 8.

According to the present embodiment, when the handle lever 21 is pulled, the inner wire 40 of the latch releasing cable 26 is pulled via the swing arm 30 attached to the inner piece 36. As a result, the latched state between the locking device 4 and the striker 5 is released, and the tailgate 3 is operated to open.

Here, for example, in a case where due to an impact applied to the rear of the vehicle body 1, the edge of the opening 18 of the license garnish 13 is deformed as shown by the chain line arrow in FIG. 4, and is moved towards the vicinity of the handle lever 21 of the door outer handle 9, specifically towards the outer piece 35 of the handle lever 21. If the extensions 43 are not provided, then the handle lever 21 might be rotated by the edge of the license garnish 13 which is moved as is. However, in the present embodiment, the license garnish 13 abuts against the respective extensions 43, and hence the license garnish 13 is reliably kept from entering any farther.

Therefore, a situation where the edge of the license garnish 13 collides with the handle lever 21 and rotates the handle lever 21 in the opening direction to thereby release the latched state between the locking device 4 and the striker 5 does not arise. As a result, the opening operation of the door outer handle 9 can be reliably prevented, with a simple structure without increasing the number of parts.

Furthermore, since the extensions 43 are provided as a pair on the side walls 32 on the both ends of the base plate 20, the license garnish 13 moving towards the handle lever 21 due to impact can be stopped at two points on the both ends of the base plate 20. Accordingly, the opening operation of the door outer handle 9 can be more reliably prevented.

Furthermore, the extensions 43 are provided axially outside of the handle lever 21, that is, so as to be mutually separated towards the vehicle widthwise outside. Moreover, when viewed from the rear of the vehicle body, a certain level of clearance C is ensured between the axial opposite ends of the handle lever 21 and the extensions 43. As a result, the extensions 43 do not block the rotation operation of the handle lever 21, and do not negatively affect the normal operation of the handle lever 21.

Furthermore, when the handle lever 21 is viewed in a side view, the tips of the extensions 43 and the tip edge of the handle lever 21 are provided in approximately the same position such that the handle lever 21 does not protrude from the extensions 43. As a result, it becomes possible to project the tip edge of the handle lever 21 to the maximum, and hence the force to operate the handle lever 21 can be minimized, and the operability can be improved, while preventing erroneous opening operation of the handle lever 21 by means of the extensions 43.

The present invention is not limited to the above embodiment, and may be applied to, for example, a side door or a bonnet, rather than the tailgate 3. Moreover, it is not limited to a vehicle such as an automobile, and may be applied to a vending machine, an electrical appliance, and the like, as long as it includes a door.

While a preferred embodiment of the invention has been described and illustrated above, it should be understood that this is exemplary of the invention and is not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A door outer handle opening operation prevention structure comprising:

a base plate having an upper edge, a lower edge, and two opposite end portions, the base plate configured for abutting attachment to an outer panel of a vehicle;

a side wall that projects from one of the end portions of said base plate; and a handle lever that is rotatably supported by said side wall, wherein:

said side wall includes:

an extension that covers the exterior of said handle lever when said base plate is viewed in a side view, and an inner portion formed integrally with said extension;

wherein said extension is arranged so as to form a predetermined clearance with respect to said handle lever, while the inner portion of said side wall is arranged so as to be closer to the handle lever than said extension, and wherein:

said handle lever has an outer piece and an inner piece, and is formed in a substantially U-shape in cross-section; and when said handle lever is not operated and when said structure is viewed in a side view, said extension covers said outer piece such that a tip of said outer piece is covered, while said inner portion of said side wall covers said inner piece.

2. The door outer handle opening operation prevention structure according to claim 1, further comprising another said side wall, wherein said side walls are respectively provided on said opposite end portions of said base plate.

3. The door outer handle opening operation prevention structure according to claim 1, wherein said extension is covered with a handle cover garnish.

4. The door outer handle opening operation prevention structure according to claim 1, wherein a position of a tip of said extension, and a position of a tip edge of said handle lever are substantially aligned when viewed in the side view.

5. The door outer handle opening operation prevention structure according to claim 1, wherein said base plate and said side wall are integrally formed as a unitary member.

6. The door outer handle opening operation prevention structure according to claim 1, wherein said handle lever is substantially U-shaped in section, normally opening downwardly.

7. The door outer handle opening operation prevention structure according to claim 1, wherein the structure is adapted to be placed on a rear door of a vehicle.

8. The door outer handle opening operation prevention structure according to claim 1, wherein:

said handle lever has an outer piece and an inner piece, and is formed in a substantially U-shape in a cross-section; and when said handle lever is not operated and when said side wall is viewed in a side view, said extension covers said outer piece while said inner portion of said side wall covers said inner piece.

9. the door outer handle opening operation prevention structure according to claim 1, further comprising:

a bracket provided to said handle lever;

a shaft attached to said bracket and said base plate, to pivotably support said handle lever; and a spring operatively attached to said shaft and said bracket, wherein:

said handle lever is formed in a substantially U-shape in cross-section, and having an outer piece, an inner piece, and a top wall;

said bracket is integrally formed on said top wall; and said handle lever is protectively shielded and covered by said side wall including said extension when the handle lever is viewed in a side view.

10. The door outer handle opening operation prevention structure according to claim 9, wherein:

said door outer handle opening operation prevention structure is mounted on a tailgate of a vehicle; and said extension is adapted to minimize effect of collision of a vehicle peripheral part with the handle lever during an impact on the vehicle.

11. the door outer handle opening operation prevention structure according to claim 9, wherein said spring is configured to urge the handle lever to remain in a standby position.

12. A door outer handle opening operation prevention structure comprising:

a base plate having an upper edge, a lower edge, and two opposite end portions, the base plate configured for abutting attachment to an outer panel of a vehicle;

a pair of side walls that project from the opposite end portions of said base plate; and a handle lever that is rotatably supported by said side walls, wherein:

each of said side walls includes:

an inner portion attached to and extending outwardly from a respective end portion of the base plate, the inner portion extending from the upper edge to the lower edge of the base plate, wherein the inner portions of the side walls define a first distance therebetween, and an extension that covers the exterior of said handle lever when said base plate is viewed in a side view, and which prevents the handle lever from being unintentionally operated in the event of a collision;

wherein the inner portion is formed integrally with said extension, wherein the base plate has a lateral width which is substantially equal to said first distance, and wherein said extension is arranged so as to form a predetermined clearance with respect to said handle lever, while the respective inner portion of each of said side walls is arranged so as to be closer to the handle lever than said extension.

13. the door outer handle opening operation prevention structure according to claim 12, wherein said extensions are covered with a handle cover garnish.

14. The door outer handle opening operation prevention structure according to claim 12, wherein a position of a tip of each said extension, and a position of a tip edge of said handle lever are substantially aligned when viewed in the side view.

15. The door outer handle opening operation prevention structure according to claim 12, wherein said base plate and said side walls are integrally formed as a unitary member, wherein the side walls include proximal ends adjacent the base plate and distal ends remote from the base plate, and wherein the distal ends of the side walls are not interconnected except via the base plate, by a respective integral connection between each side wall inner portion and the base plate.

16. The door outer handle opening operation prevention structure according to claim 12, wherein said handle lever is substantially U-shaped in section, normally opening downwardly.

17. The door outer handle opening operation prevention structure according to claim 12, wherein the structure is adapted to be placed on a rear door of a vehicle.

18. The door outer handle opening operation prevention structure according to claim 12, wherein:

said handle lever has an outer piece and an inner piece, and is formed in a substantially U-shape in a cross-section; and, when said handle lever is not operated and when said side walls are viewed in a side view, each of said extensions covers said outer piece while said inner portion of each of said side walls covers said inner piece.

* * * * *